United States Patent [19]

Gray et al.

[11] 4,430,103

[45] Feb. 7, 1984

[54] CRYOGENIC RECOVERY OF LPG FROM NATURAL GAS

[75] Inventors: Michael L. Gray; William A. McClintock, both of Bartlesville, Okla.

[73] Assignee: Phillips Petroleum Company, Bartlesville, Okla.

[21] Appl. No.: 351,728

[22] Filed: Feb. 24, 1982

[51] Int. Cl.[3] ..... F25J 3/02

[52] U.S. Cl. ..... 62/28; 62/31; 62/34

[58] Field of Search ..... 62/9, 11, 23, 24, 27, 62/28, 31, 32, 34, 42

[56] References Cited

U.S. PATENT DOCUMENTS

| | | | |
|---|---|---|---|
| 3,581,511 | 6/1971 | Peck | 62/28 |
| 3,721,099 | 3/1973 | Forg et al. | 62/28 |
| 4,235,613 | 11/1980 | Castoe et al. | 62/28 |

*Primary Examiner*—Frank Sever

[57] ABSTRACT

In accordance with the present invention a natural gas stream predominating in methane and containing significant amounts of $C_2$, $C_3$, $C_4$ and $C_5$ and higher molecular weight hydrocarbons is cooled in a plurality of cooling stages to a temperature sufficient to produce at least one liquid phase portion predominating in $C_2$, $C_3$, $C_4$ and $C_5$ and higher molecular weight hydrocarbons, the at least one liquid phase portion predominating in $C_2$, $C_3$, $C_4$ and $C_5$ and higher molecular weight hydrocarbons is separated from the main gas stream during the course of the cooling, the thus separated liquid phase portion or portions predominating in $C_2$, $C_3$, $C_4$ and $C_5$ and higher molecular weight hydrocarbons is further separated into a vapor phase portion predominating in $C_2$, $C_3$, and $C_4$ hydrocarbons and at least one liquid phase portion predominating in $C_5$ and higher molecular weight hydrocarbons, at least one second separation step, at least one portion of the at least one vapor phase portion predominating in $C_2$, $C_3$ and $C_4$, hydrocarbons is recovered as at least one product of the process and at least one portion of the remaining portion of the at least one phase portion predominating in $C_2$, $C_3$ and $C_4$ hydrocarbons is recycled to and recombined with the main gas stream as a liquid phase.

18 Claims, 4 Drawing Figures

CRYOGENIC RECOVERY OF LPG FROM NATURAL GAS

BACKGROUND OF THE INVENTION

The present invention relates to the cryogenic recovery of liquefied petroleum gas from a natural gas stream. In a more specific aspect, the present invention relates to a process for liquefying a natural gas stream in which the volume of liquefied petroleum gases separated from or recycled to the natural gas stream can be controlled at will and energy requirements of the process reduced.

A number of processes are known, in the prior art, for the liquefaction of natural gas, primarily to permit the practical transportation of such gases over long distances where pipelines for the transport of the gas in its gaseous state cannot be utilized. The most predominant practice is, of course, liquefaction of natural gas for transport by ocean-going vessels.

In the liquefaction of natural gas, it is customary to first remove acid gases such as $CO_2$ and $H_2S$ and then pass the gas through a dehydration system to remove water. Normally the gas is then cooled to a temperature sufficiently low to liquefy the same at essentially atmospheric pressure. Such cooling can be carried out by passing the gas sequentially through a plurality of cooling stages at successively lower temperatures and in which the cooling is supplied by the expansion of compressed refrigerants either derived from the natural gas itself or from an external source. One common practice is to utilize a series of successively lower boiling point refrigerants, such as propane or propylene followed by ethane or ethylene and then methane. The refrigerants utilized as cooling mediums are supplied in liquefied form by compression-refrigeration units often arranged in cascade fashion. However, the more efficient processes compress the gas to a high pressure, if it is not already at a sufficiently high pressure, prior to cooling and substitute a series of pressure reduction or flash stages for the methane cycle. This not only has the advantage of further cooling the gas as it is being reduced to essentially atmospheric pressure but gases flashed as a result of the pressure reduction steps can be utilized to further cool the liquefied gas and then by recycled to the main gas stream. While the predominant component of natural gas is methane, such gases can also contain significant amounts of $C_2$ and higher molecular weight hydrocarbons. As the gas is progressively cooled the components of higher molecular weight than methane generally condense first. While the normally liquid components, such as $C_5$ and higher molecular weight hydrocarbons, increase the heating value of the gas, they are of greater value as natural gas liquids for blending with motor fuels and for other purposes. In addition, failure to remove $C_5$ and heavier hydrocarbons at an early stage can cause freezing problems in later stages of the process. It is, therefore, common practice to remove such natural gas liquids from the natural gas and recover the same as a product. This is normally done by placing one or more vapor-liquid separators at appropriate points in the cooling stream to separate the condensed $C_2$ and higher molecular weight hydrocarbons from the main gas stream. The thus separated $C_2$ and higher molecular weight hydrocarbons are the normally sent to another separator, which is usually a fractionating system of some type in which the $C_2$ and higher molecular weight hydrocarbons are separated into a vapor phase stream or streams containing predominately $C_2$ and higher molecular weight, normally gaseous, hydrocarbons and a liquid phase comprising the natural gas liquids. The vapor phase is then combined with flashed vapors from the pressure reduction steps, compressed to a pressure essentially equal to the pressure of the main gas stream, at some point upstream of the liquefaction step, and recombined with the main gas stream at such appropriate point where the pressure of the recycle gas and the main gas stream are essentially equal.

This practice of recycling $C_2$ and normally gaseous, higher molecular weight hydrocarbons back to the main gas stream has a number of disadvantages. First of all, ethane and higher molecular weight normally gaseous, hydrocarbons are often of greater value as chemical feedstocks than as a component of the liquefied natural gas. In the case of propane and butane these components are also of greater value as separate liquefied petroleum gases or LPG. Secondly, by recombining $C_2$ and normally gaseous, higher molecular weight hydrocarbons with flashed gases from the pressure reduction cycle the load on the compressors utilized to compress the recycle gas is significantly increased. Finally, when the $C_2$ and normally gaseous, higher molecular weight hydrocarbons, separated from the main gas stream, are recycled directly to the main gas stream, there is not only a loss of the heat capacity of these fluids, which could be conveniently used for in-plant heating, but the energy necessary to separate individual $C_2$, $C_3$ and $C_4$ hydrocarbons from such very low temperature fluids, at a later stage, is also significant.

SUMMARY OF THE INVENTION

It is therefore an object of the present invention to overcome the above-mentioned and other disadvantages of the prior art processes. Another object of the present invention is to provide an improved process for the cryogenic separation of $C_2$ and higher molecular weight hydrocarbons from a natural gas feed. Another and further object of the present invention is to provide an improved process for the cryogenic separation of at least one of $C_2$, $C_3$ and $C_4$ hydrocarbons from a natural gas stream wherein the thus separated $C_2$, $C_3$ and $C_4$ hydrocarbons can be recovered as a product of the process and the volume of such components thus recovered as a product can be adjusted to meet the needs or desires of the operator. Another object of the present invention is to provide an improved process for the separation of $C_2$ and higher molecular weight hydrocarbons from a natural gas stream, which is to be liquefied, in which $C_2$, $C_3$ and $C_4$ hydrocarbons to be recycled and recombined with the main gas stream are thus recombined in liquid form. Yet another object of the present invention is to provide an improved process for the cryogenic separation of $C_2$ and higher molecular weight hydrocarbons from a natural gas stream, which is to be liquefied, wherein at least part of at least one of the $C_2$, $C_3$ and $C_4$ hydrocarbons are recycled and recombined with the main gas stream and in which the load on compressors utilized to recompress gases for recycle and recombination is significantly reduced. Yet another object of the present invention is to provide an improved process for the cryogenic separation of $C_2$ and higher molecular weight hydrocarbon from a natural gas stream in which the refrigeration load is moved backward or upstream, thus reducing the energy necessary to compress refrigerants utilized in the cooling of the gas. Another and further object of the present invention is to provide an improved process for the cryogenic separation of $C_2$ and higher molecular weight hydrocarbons from a natural gas stream in which heat is recovered from condensed liquids separated from the main gas stream. Yet another object of the present invention is to provide an improved process for the cryogenic separation of $C_2$ and higher molecular weight hydrocarbons from a natural gas stream in which the energy required to separate the $C_2$ and higher molecular weight hydrocarbons from one another is significantly reduced. These and other objects of the present invention will be apparent from the following description.

In accordance with the present invention a natural gas stream predominating in methane and containing significant amounts of $C_2$, $C_3$, $C_4$ and $C_5$ and higher molecular weight hydrocarbons is cooled in a plurality of cooling stages to a temperature sufficient to produce at least one liquid phase portion predominating in $C_2$, $C_3$, $C_4$ and $C_5$ and higher molecular weight hydrocarbons, such liquefied portion or portions is separated from the main gas stream during the course of the cooling, and at least a portion of the thus separated liquid phase portion or portions predominating in $C_2$, $C_3$, $C_4$ and $C_5$ and higher molecular weight hydrocarbons is recovered as a product and the remainder of the at least one liquid phase predominating in $C_2$ and higher hydrocarbon is recycled to the main gas stream. The thus separated liquid portion can be further separated into a vapor phase portion predominating in $C_2$ hydrocarbons and at least one liquid phase portion predominating in $C_3$, $C_4$ and $C_5$ and higher molecular weight hydrocarbons, at least one portion of the at least one liquid phase portion predominating in $C_3$, $C_4$, $C_5$ and higher molecular weight hydrocarbons can be recovered as at least one product of the process and the at least one remaining portion of the at least one liquid phase portion predominating in $C_3$, $C_4$ and $C_5$ and higher molecular weight hydrocarbons can be recycled to and recombined with the main gas stream. In a further aspect of the present invention the thus recycled $C_2$, $C_3$ and $C_4$ hydrocarbons are recycled as a liquid phase. In a more specific aspect, heat capacity is recovered from at least a part of the condensed liquids separated from the main gas stream by utilizing the same for in-plant heating.

DESCRIPTION OF THE PREFERRED EMBODIMENTS

The nature of the present invention and the advantages thereof will be apparent from the following detailed description when read in conjunction with the drawings.

While the present invention may be utilized in conjunction with any process for the cryogenic separation of $C_2$ and higher molecular weight hydrocarbons from any natural gas stream, the present process is most useful and effective in the separation of $C_2$ and higher molecular weight hydrocarbons from a natural gas stream during the liquefaction of such natural gas stream to produce a liquefied natural gas (LNG) product. Also, since most natural gas streams, to be liquefied, normally contain some $C_2$ and higher molecular weight hydrocarbons, the present invention is most useful and most effective in the treatment of natural gas streams containing significant amounts of $C_2$ and higher molecular weight hydrocarbons. A typical natural gas stream which can be effectively processed in accordance with the present invention would have the following composition.

TABLE I

| Component | Mol % |
|---|---|
| $N_2$ | 6.01 |
| $C_1$ | 83.65 |
| $C_2$ | 6.86 |
| $C_3$ | 2.15 |
| $C_4$ | 0.80 |
| $C_5^+$ | 0.32 |
| He | 0.21 |

Figure 1A:
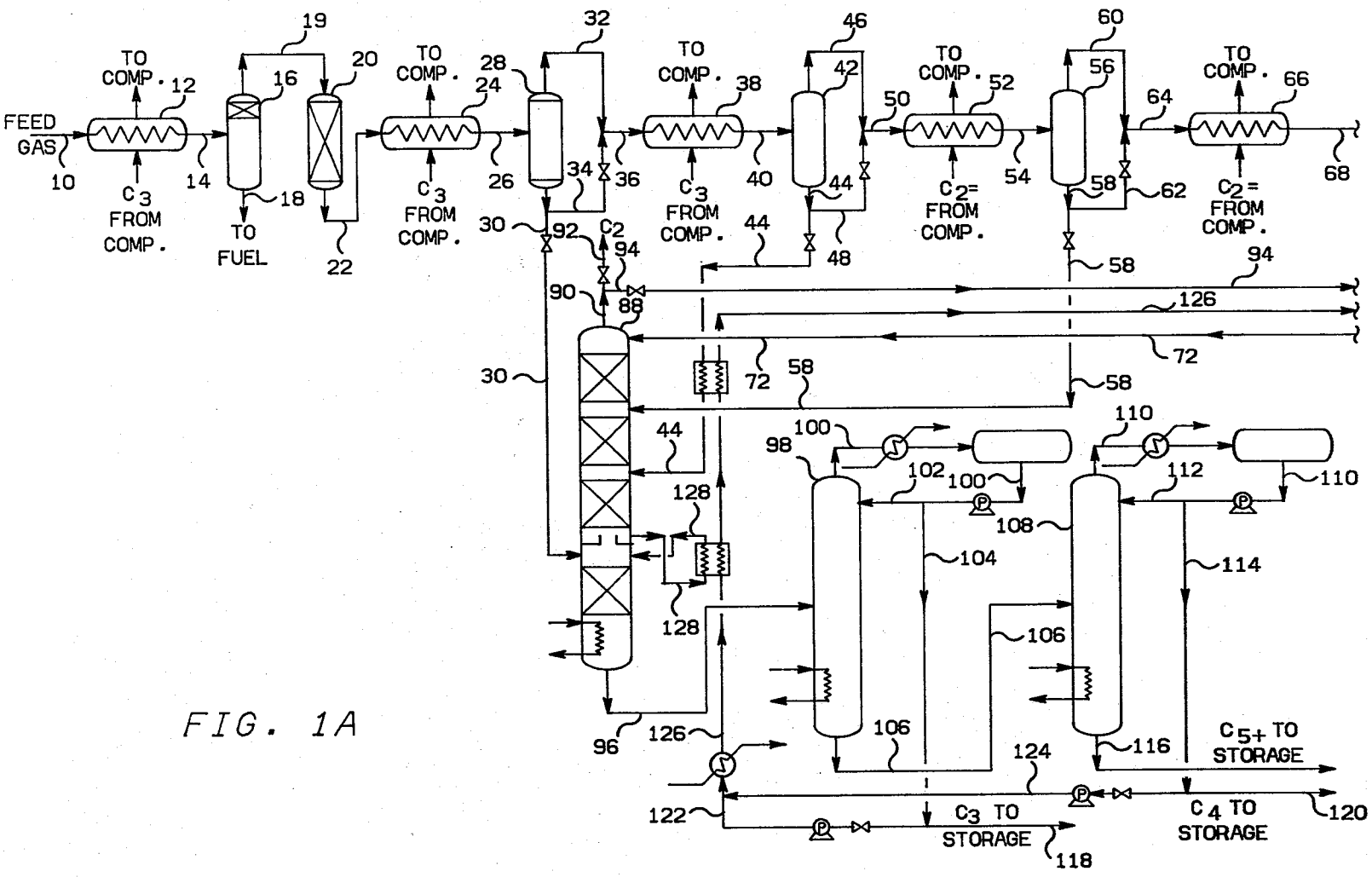
FIGS. 1A, B, shows in schematic form, a natural gas liquefication system incorporating the present invention.
Figure 1B:
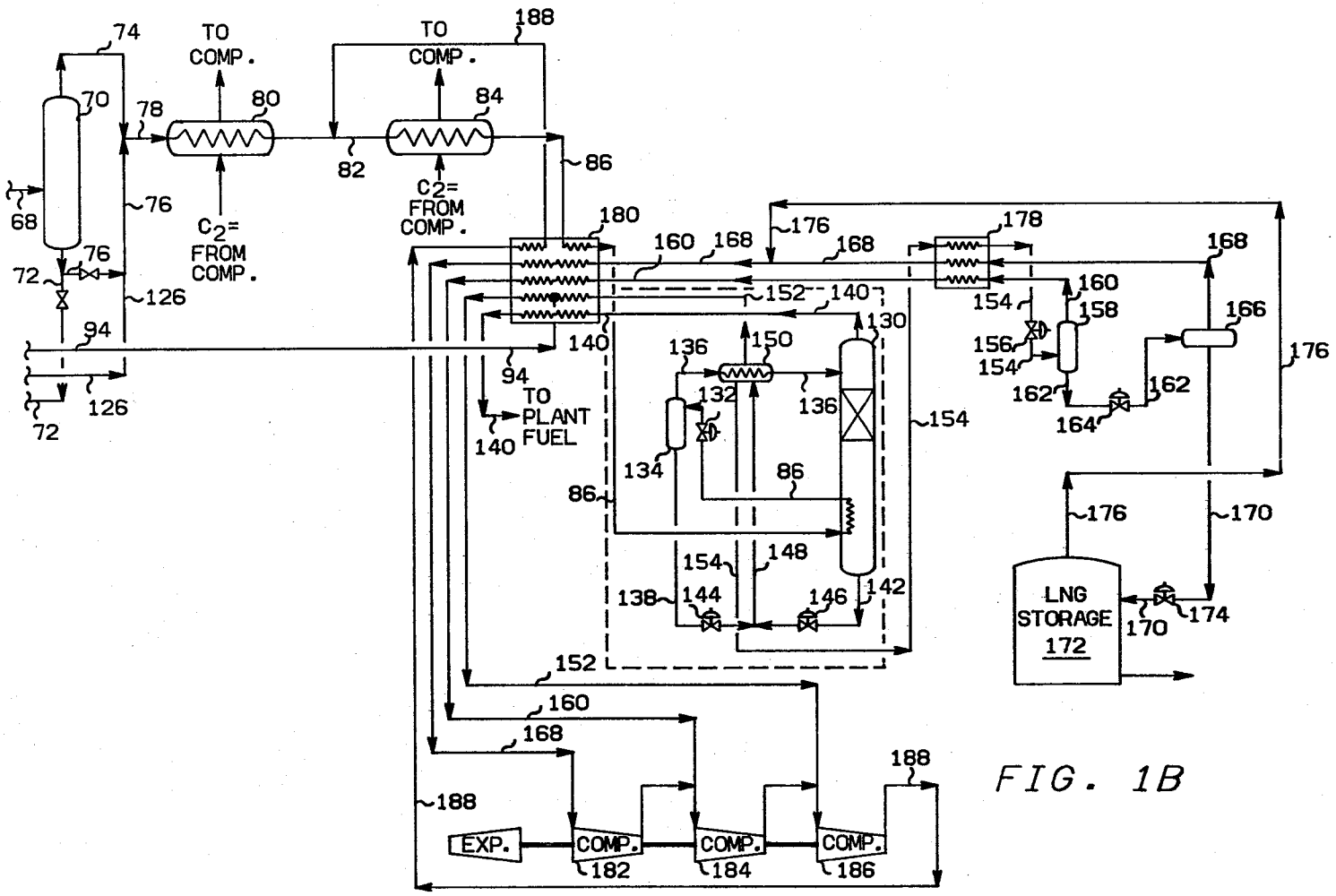

With reference to FIG. 1 of the drawings it is to be understood that the feed gas has been subjected to conventional treatments to remove acid gases such as $CO_2$ and $H_2S$. It is also to be understood that, if the gas is not already at a high pressure, the gas has been compressed to a high pressure between about 300 and 1500 psia and typically between about 500 and 900 psia. In accordance with FIG. 1, the natural gas feed is introduced to the system through line 10. The feed gas then passes in indirect heat exchange with a body of fluids produced by expanding liquefied propane in a high stage propane feed gas chiller 12. The compressed and liquefied propane is supplied from a conventional compression-refrigeration system (not shown). The cooled feed gas then passes through line 14 to vapor-liquid separator 16. In passing through chiller 12 a portion of the highest molecular weight hydrocarbons contained in the feed gas are condensed and are separated from the main gas stream in separator 16. Separator 16 is commonly referred to as a dehydrator-liquid knockout pot. A bottoms liquid portion is withdrawn through line 18 and is suitable for use as a fuel and the remaining portion of the main gas stream is passed through line 19 to dehydrator 20. Dehydrator-regeneration equipment, normally associated with dehydrator 20, is not shown. The dehydrated main gas stream then passes through line 22 to intermediate stage propane feed gas chiller 24. Feed gas leaving chiller 24 passes through line 26 to a vapor-liquid separator 28 where liquids condensed by chiller 24 are separated and discharged through line 30 while the vapor phase portion of the main gas stream is discharged through line 32. Flexibility is provided to the extend that at least a portion of the separated liquid passing through line 30 may be recombined with the main gas stream through line 34 and the combined stream passed through line 36 to low stage propane feed gas chiller 38. The main gas stream from chiller 38 passes through line 40 to vapor-liquid separator 42 wherein liquids condensed by chiller 38 are withdrawn through line 44 and the remaining vapor state main gas stream is discharged through line 46. Again, flexibility of operation can be provided by passing at least a part of the liquid withdrawn through line 44 through line 48 where it is combined with the main gas stream in line 50. The main gas stream passing through line 50 is fed to high stage ethylene feed gas chiller 52. From chiller 52 the main gas stream passes through line 54 to vapor-liquid separator 56. In separator 56, condensed liquids are withdrawn through line 58 and the remaining main gas stream in a vapor stage is withdrawn through line 60. At least a portion of the liquid withdrawn through line 58 may be recombined with the main gas stream through line 62. The main gas stream then passes through line 64 to a first intermediate stage ethylene feed gas chiller 66. From chiller 66 the main gas stream passes through line 68 to vapor-liquid separator 70. In vapor-liquid separator 70 condensed liquid is separated and withdrawn through line 72 and the main feed gas stream, in a vapor state, is discharged through line 74. At least a portion of the separated liquid passing through line 72 may be recombined with the main gas stream through line 76. At this point most of $C_2$ and higher molecular weight hydrocarbons have been removed from the feed gas and the feed gas is composed principally of methane. The main gas stream then passes through line 78 to second intermediate stage ethylene feed gas chiller 80 where it is further cooled and a significant portion thereof liquefied. The cooled main gas stream then passes through line 82 to low stage ethylene feed gas chiller 84 wherein the feed gas, comprising principally methane, is liquefied and passed through line 86. The further treatment of the liquefied gas passing through line 86 will be described at a later point in the description.

While propane and ethylene have been shown as refrigerants for the liquefication of the natural gas feed, it is to be understood that other appropriate refrigerants may be utilized. For example, propylene may be substituted for propane and ethane could be utilized in place of ethylene. Ethylene is supplied to the ethylene feed gas chillers as a compressed liquid which is expanded into the chillers and the feed gas to be cooled is then passed in indirect heat exchange with the fluids produced by expanding the ethylene. Again, the ethylene compression-refrigeration system is conventional and is not shown in the drawings nor is the cascading of the propane and ethylene systems.

The liquid phase portions separated from the main gas stream in separators 28, 42, 56 and 70 and comprising predominately $C_2$, $C_3$, $C_4$, and $C_5$ and higher molecular weight hydrocarbons are then passed to separator 88 for further separation. In this particular case the preferred separator 88 is a fractionation column equipped with appropriate packing or bubble trays to provide intimate contact of fluids in the column. Column 88 will generally be supplied with sufficient heat to vaporize a portion of the liquid phase streams, as by a steam heater or other appropriate means in the bottom of the column. The first separated liquid phase portion passing through line 30 is preferably introduced at a lowermost point in the column while the second, third and fourth liquid phase portions passing through lines 44, 58 and 72, which have successively lower boiling points, will be introduced at successively higher points in the system. Thus, the uppermost introduced fluids act as a reflux for the fluids introduced at lower points while the vapors from the fluids introduced at lower points act as a stripping means for the fluids introduced at points thereabove. Column 88 is operated in a manner such that a vapor phase predominating in $C_1$ and/or $C_2$ hydrocarbons will be vaporized and discharged from the column through line 90. If desired, at least a portion of the $C_2$ and lower boiling components may be withdrawn through line 92 since, depending upon the $C_2$ content of the feed gas and the needs of the operator, the $C_2$ components may be utilized as a chemical feedstock. In a preferred embodiment, however, all of the $C_2$ and lower boiling components are withdrawn through line 94 and are recombined with the main gas stream as hereinafter described. As described, column 88 is operated as what is known as a deethanizer column. The remaining liquid phase separated in column 88 and comprising predominately $C_3$, $C_4$ and $C_5$ and higher molecular weight hydrocarbons is withdrawn through line 96 and fed to separator 98 for further separation. Column 98 is preferably a bottom heated column as shown in the drawings. In column 98, normally referred to as a depropanizer, $C_3$ hydrocarbons are vaporized to produce a vapor phase portion predominating in $C_3$ hydrocarbons, which is discharged through line 100. As shown in the drawings the vapor phase portion predominating in $C_3$ hydrocarbons may be cooled to condense the same and a portion of the condensed $C_3$ hydrocarbons introduced into column 98 as a reflux through line 102. However, the major portion of the liquefied stream predominating in $C_3$ hydrocarbons is passed through line 104 for further processing or recovery as hereinafter described. The liquid phase portion separated in column 98 and predominating in $C_4$ and $C_5$ and higher molecular weight hydrocarbons is discharged through line 106 and passed to column 108. Column 108 is similar to separator 98 and is preferably a heated column, as shown. Column 108 is operated in a manner such that a vapor phase portion predominating in $C_4$ hydrocarbons is produced and discharged through line 110. Accordingly, column 108 is referred to as a debutanizer column. This vapor phase product is then cooled and condensed and a portion may be introduced into column 108 as a reflux through line 112. The condensed or liquefied $C_4$ hydrocarbon stream is then discharged through line 114. The liquid phase portion separated in column 108 is discharged through line 116 to storage. Since this liquid phase portion predominates in $C_5$ and higher molecular weight hydrocarbons, it is commonly referred to as a natural gas liquids (NGL) stream and it may be utilized as a blending stock for gasoline or other appropriate uses.

Since $C_3$ and $C_4$ hydrocarbons are valuable as chemical feedstocks or as liquefied petroleum gases (LPG) they may be recovered from the system through lines 118 and 120, respectively, for further use. Since the remaining portions of the $C_3$ and $C_4$ streams are in the liquid state they can then be conveniently pumped through lines 122 and 124, respectively. The remaining $C_3$ and $C_4$ streams are then combined and passed through line 126. The remaining $C_3$ and $C_4$ streams passing through line 126 is recombined with the main gas stream as shown in the FIG. 1. By thus recycling and recombining the $C_3$ and $C_4$ streams with the main gas stream in a liquid state, this combined stream can be added directly to the main gas stream rather than added to the hereinafter mentioned methane vapors which are recycled to the gas stream. The recombination of the combined $C_3$–$C_4$ stream with the main gas stream is most conveniently carried out after the last separation of a liquid phase portion from the main gas stream, specifically after vapor-liquid separator 70 as shown in FIG. 1. The combined $C_3$ and $C_4$ stream, which is recyled to the main gas stream, can be passed in indirect heat exchange with at least a portion of the liquid phase portions separated from the main gas stream in separators 28, 42, 56 and 70. More specifically, the combined $C_3$ and $C_4$ stream is passed in indirect heat exchange with a liquid stream withdrawn from and reintroduced into column 88 through line 128 and/or in indirect heat exchange with the liquid phase portion separated in separator 42 and passed through line 44 to column 88. This mode of recycling the remaining portions of the $C_3$ and $C_4$ hydrocarbon streams has a number of advantages. By recycling the $C_3$ and $C_4$ stream back to the main feed gas stream as a liquid and downstream of the last separation step 70, rather than recombining the same with methane vapors, hereinafter referred to, in a conventional manner, the load on the methane compressors which compress the methane for recycle to the main feed gas stream is substantially reduced. Further, the heat capacity of the liquid phase portion separated in separators 28, 42, 56 and 70 is also conveniently utilized in the system itself to supply a portion of the heat for Col. 88.

The liquefied main gas stream, while a liquid at the elevated pressure previously mentioned, is preferably further cooled to a temperature (about −240° to −260° F.) such that it will be a liquid at essentially atmospheric pressure while at the same time reducing the liquefied gas pressure to said atmopheric pressure. In addition, to the extent that significant amounts of nitrogen are present in the natural gas feed, this nitrogen is preferably also removed before recovery of the liquefied natural gas for storage and/or shipment. These objectives are accomplished by a plurality of sequential pressure reduction stages. In the first pressure reduction stage, most of the nitrogen is removed as a vapor and, since this vapor stream will normally contain a substantial portion of methane, this vapor stream is normally utilized as a fuel within the liquefaction system. The remaining liquefied gas is then passed through a plurality of additional pressure reduction stages where the pressure is ultimately reduced to atmospheric pressure. In the system shown in the drawings, rather than utilize a single separator for the separation of the nitrogen, two separators are employed. Specifically, the liquefied gas passing through line 86 is passed through a reboiler in the bottom of nitrogen column 130, where it supplies heat to the column for the vaporization of a nitrogen-enriched stream. The liquefied natural gas then passes through an expansion valve 132 where it is expanded to vaporize a portion thereof. The expanded, liquefied natural gas is then passed to separator 134 where vapors flashed from the liquefied natural gas are separated through line 136 and the remaining natural gas liquid is discharged through line 138. The flashed gas passing through line 136 is then charged to column 130 for further separation and, thus, separation to produce the nitrogen-enriched vapor phase, which is passed through line 140 and ultimately withdrawn as a plant fuel for use within the liquefication system. The remaining liquefied natural gas from column 130 is discharged through line 142. Rather than utilizing a nitrogen column 130, as shown in the drawing, the vapor phase from separator 134 could be passed through an expansion valve, such as 132, and into a separator, similar to separator 134, or both expander 132-separator 134 and column 130 can be replaced by a single nitrogen column, such as column 130, or a single combination of an expander 132-separator 134. The remaining liquefied natural gas passing through lines 138 and 142 from separator 134 and column 130, respectively, may be passed through expansion valves 144 and 146, respectively, and then combined in line 148. While a single expansion valve could be utilized in line 148, since pressures of the liquids passing through lines 138 and 142 may be different it is most convenient to utilize individual expansion valves 144 and 146. The combined liquefied natural gas stream passing through line 148 which has been expanded to vaporize a portion thereof is then passed to a high stage separator 150. Expansion valves 144 and 146 and separator 150 comprise an expander-separator combination similar to expander-separator 132–134. Consequently, the combined stream of liquefied natural gas passing through line 148 could then be passed to a conventional high stage expander-separator flash drum. However, in the preferred embodiment shown, the separator flash drum 150 doubles as a cooler or chiller which condenses at least a portion of the flashed vapors passing from flash drum 134 through line 136 to column 130. High stage separator-flash drum 150 is a tube and shell type chiller, constructed in essentially the same fashion as the chillers utilized to cool the feed gas with propane and ethylene but could also be a can-type plate and fin heat exchanger. Specifically, the vapors passing through line 136 pass through the tubes of the chiller in indirect heat exchange with the fluids produced by the expansion of the liquefied natural gas introduced through line 148. In separator 150 vapors produced by the expansion of the liquefied natural gas are discharged through line 152 while the remaining liquefied natural gas in liquid phase is discharged through line 154. The liquefied natural gas passing through line 154 is expanded through expansion valve 156 into a separator or flash drum 158. Expander 156 and flash drum 158 comprise an intermediate stage expansion or flash step. The vapors flashed, by the expansion through valve 156, are removed from separator 158 through line 160 while the remaining liquefied natural gas is discharged through line 162. The liquefied natural gas passing through line 162 is expanded through valve 164 into separator or flash drum 166. Expander 164 and flash drum 166 comprise a low flash stage or pressure reduction. Flashed vapors from separator 166 are discharged through line 168 while the remaining liquefied natural gas is discharged through line 170. Liquefied natural gas from line 170 is then passed to a liquefied natural gas storage means 172, as a product of the process. If necessary or desired the liquefied natural gas may be still further expanded through expansion valve 174 to ultimately reduce the pressure of the liquefied natural gas to atmospheric pressure. Flashed vapors produced by expansion through valve 174 and/or vapors normally produced in storage means 172 are discharged through line 176.

In order to utilize the refrigeration capacity of the flashed gases produced in the pressure reduction stages, these flashed vapors are preferably passed in indirect heat exchange with the liquefied natural gas at appropriate points. Specifically, flashed vapors passing through line 168 from flash drum 166 and line 160 from flash drum 158 are passed in indirect heat exchange with liquefied natural gas passing through line 154 in an indirect heat exchanger or methane interstage economizer 178. Vapors from storage means 172 passing through line 176 may then be combined with the vapors passing through line 168 following methane interstage economizer 178. Flashed vapors passing through line 168 and 160 along with flashed vapors passing through lines 152 and 140 from high stage flash drum 150 and nitrogen column 130, respectively, may then be passed in indirect heat exchange with the main stream of liquefied natural gas passing through line 86, in indirect heat exchanger or high stage methane economizer 180. As previously indicated, the nitrogen-enriched flashed vapors passing through line 140 are then utilized as a plant fuel after passage through economizer 180. Flashed vapors passing through lines 168, 160 and 152, following their use in economizer 180, are then passed to low stage compressor 182, intermediate stage compressor 184 and high stage compressor 186 where they are compressed for recycle to the main gas stream. The recombined and compressed methane is then passed through line 188, also preferably through economizer 180, and back to the main gas stream at a point where the pressure of the recycle methane is essentially equal to the pressure of the main gas stream. In the present case, the preferred point of recombination of the compressed recycle methane with the main gas stream is in line 82 between the second intermediate stage ethylene feed chiller 80 and low stage ethylene feed gas chiller 84. Finally, the $C_2$ and lower boiling constituents separated in column 88 and passing through line 94 are recombined with flashed vapors from the high stage flash means 150, either prior to, after, or, as shown, at an intermediate point in economizer 180.

The following table exemplifies typical temperatures and pressures for the operation of the present invention. The numerical references to lines or items of equipment correspond to the numerical designations of the FIGURE of the drawing.

TABLE II

| Line or Item of Equipment | Temperature °F. | Pressure psia |
|---|---|---|
| 26 | −7 | 575 |
| 40 | −28 | 570 |
| 54 | −67 | 565 |
| 68 | −90 | 560 |
| 86 | −134 | 550 |
| 88 | −54 | 197 |
| 98 | 103 | 205 |
| 108 | 105 | 75 |
| 126 | 85 | 570 |

Figure 2A:
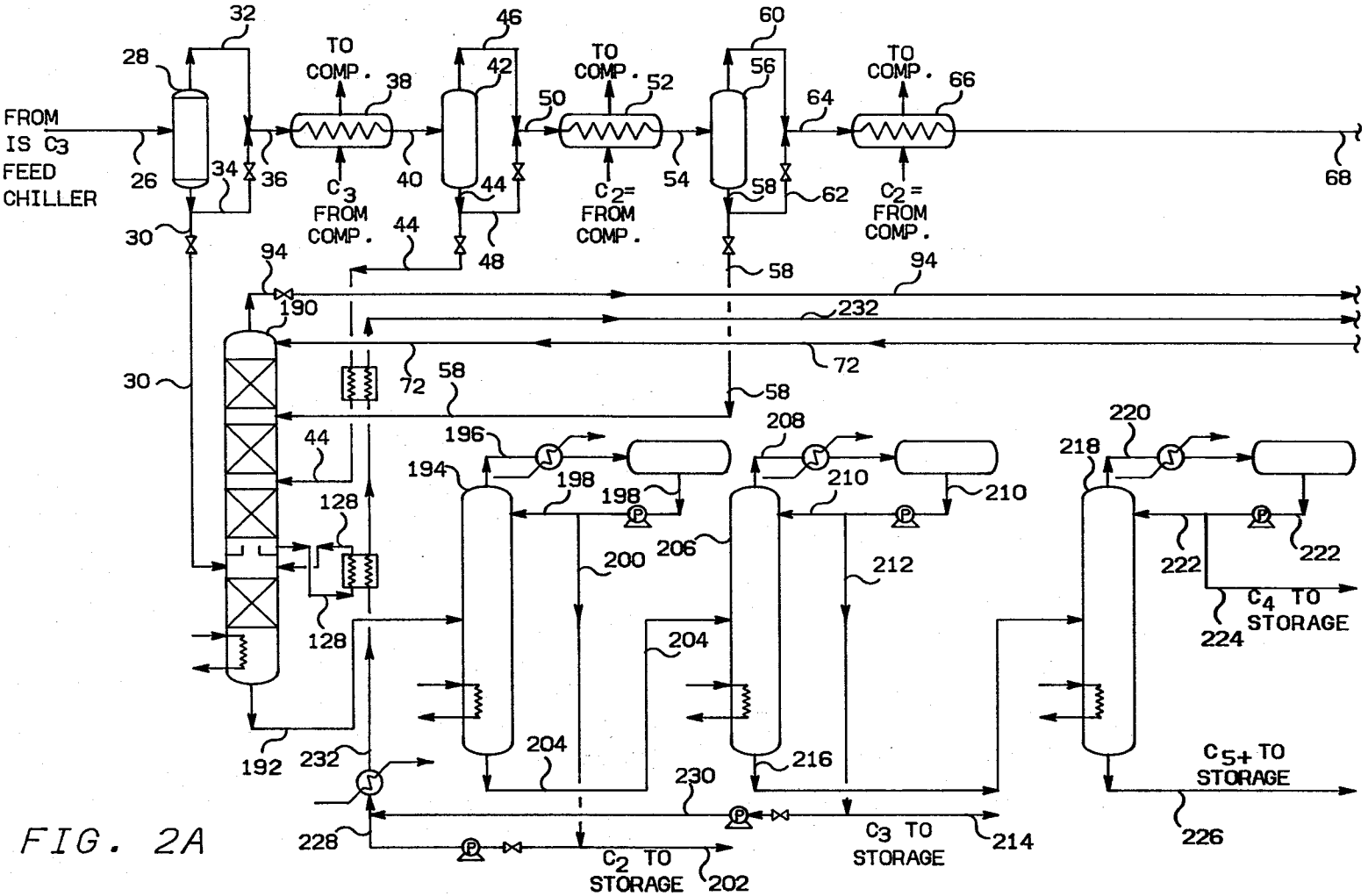
FIGS. 2A, B, shows a partial schematic of a gas liquefaction process including another embodiment of the present invention.
Figure 2B:
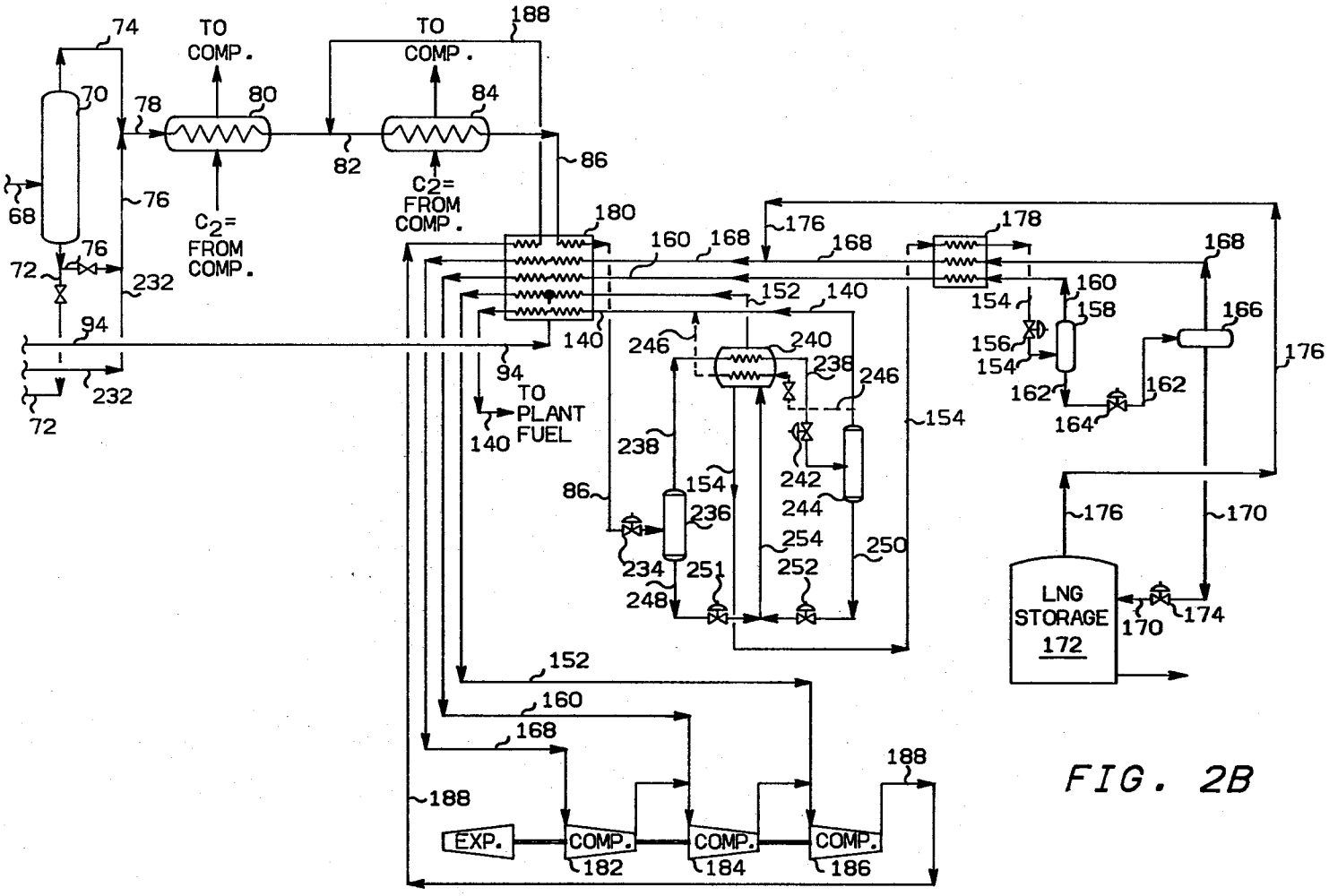

FIG. 2 of the drawings is a partial schematic of a natural gas liquifaction and separation system, such as that shown in FIG. 1 of the drawings, and includes the preferred system of the present invention for separation of $C_2$ and higher molecular weight hydrocarbons from a natural gas stream. In FIG. 2, to the extent that items of equipment and flow lines are the same as those shown in FIG. 1, the same identifying numbers have been used.

The main gas stream, after cooling in feed chiller 24 (FIG. 1) and passing through line 26, proceeds through the remainder of the cooling cycles in the same manner as previously described in connection with the description of FIG. 1. However, the liquid portions separated from the main gas stream during the cooling cycles and passing through lines 30, 44, 58 and 72 (FIGS. 1 and 2, as appropriate) are fed to column 190. Column 190 is similar to column 88 of FIG. 1 and the liquid portions fed to the column are introduced in essentially the same manner and at essentially the same points as they were in the system of FIG. 1; but in this instance, column 190 is operated as a demethanizer rather than a dethanizer, as in FIG. 1. Accordingly, vapors separated in column 190 comprise principally methane and whatever small amounts of nitrogen were present in the original feed. This vapor is then discharged from column 190 and passed through line 94 where it is recycled to the main gas stream, as previously described in connection with FIG. 1. The liquid portion separated in column 190 comprises principally $C_2$, $C_3$, $C_4$, $C_5$ and higher molecular weight hydrocarbons and is withdrawn through line 192. The liquid fraction withdrawn through 192 is then fed to a bottom heated column 194, where a portion thereof is vaporized. This column is similar to columns 98 and 108 of FIG. 1. Column 194 is operated as a deethanizing column and therefore, the vapor separated in column 194 comprises principally $C_2$ and is discharged through line 196. The vapor passing through line 196 is condensed and at least a portion thereof may be passed through line 198 as a reflux to column 194. The main stream, however, is passed through line 200. At least a part of the $C_2$ fraction is then passed through line 202 to storage or is recycled, as hereinafter described. The liquid phase separated in column 194 is discharged through line 204 and fed to bottom heated column 206. Bottom heated column 206 is operated as a depropanizer and, consequently, the vapor stream discharged through line 208 comprises principally $C_3$ hydrocarbons. This vapor phase, passing through line 208, is condensed and at least a portion may be recycled to column 206 through line 210. The main stream, however, is passed through line 212. At least a portion of the $C_3$ stream passing through line 212 may be withdrawn and sent to storage through line 214 or, as hereinafter described, recycled. The liquid separated in column 206 is withdrawn through line 216 and fed to column 218 operated as a debutanizer. Consequently, the vapor from column 218 comprises principally $C_4$, which is discharged through line 220. This vapor phase is then condensed and at least a portion thereof may be recycled to column 218 through line 222. The main stream, however, is withdrawn through line 224. In this particular embodiment, the $C_4$ fraction is sent to storage for other uses. However, it may be recycled, as hereinbefore described in connection with FIG. 1. The liquid separated in column 218 comprises principally the normally liquid components of the natural gas stream ($C_5$ and higher molecular weight hydrocarbons originally present in the main gas stream) and these natural gas liquids are withdrawn through line 226 and sent to storage for other use. Rather than withdrawing the $C_2$ and $C_3$ fractions from the system, at least a portion of the $C_2$ and or $C_3$ streams may be recycled as liquids through lines 228 and 230 respectively. As previously suggested, this recycle may also include at least a portion of the $C_4$ fraction passing through line 224. In any event, the $C_2$, $C_3$ and optionally $C_4$ fractions, in liquid form, are combined in line 232 and recycled to the main gas stream, as previously described in connection with FIG. 1.

As previously mentioned in the specification, a second fuel flash and separator combination can be substituted for nitrogen column 130 (FIG. 1). Referring again to FIG. 2, the liquified main gas stream passing through line 86, would, in this instance, be passed through expander valve 234 and thence to flash tank or separator 236. Vapor separated in 236 would be discharged through line 238, passed in indirect heat exchange through high stage separator 240, expanded through a second fuel flash valve 242 and thence to the flash drum or separator 244. The vapor separated in separator 244, containing most of the nitrogen originally in the main gas stream and sufficient methane to make it useful as a fuel, would be passed through line 140 for utilization as a plant fuel. Alternatively, the plant fuel stream or a portion thereof could be passed through line 246, thence through in indirect heat exchange through high stage separator 240 and then to line 140 for utilization as plant fuel. The liquid phase separated in separator 236 would be withdrawn through line 248 and passed through expansion valve 251. Likewise, the liquid stream separated in separator 244 would be passed through line 250 and expanded through expansion valve 252. The two expanded fluid streams in lines 248 and 250 would then be combined in line 254 and passed to high stage separator 240. In separator 240, the fluids would be separated into a vapor stream, withdrawn through line 152 and treated in the same manner as previously described with respect to FIG. 1. Liquid separated in separator 240 would be withdrawn through line 154 and thereafter treated in the same manner as described in connection with FIG. 1.

While specific procedures, specific conditions, specific items of equipment and arrangements have been described herein, it is to be understood that such specific references are for illustrative purposes only and are not to be considered as limiting.

We claim:

1. A process for cryogenically liquifying methane and separating $C_2$, $C_3$, $C_4$ and $C_5$ and higher molecular weight hydrocarbons from a natural gas feed predominating in methane and containing significant amounts of $C_2$, $C_3$, $C_4$ and $C_5$ and higher molecular weight hydrocarbons, comprising:

(a) cooling said natural gas feed in at least one first cooling stage to a temperature sufficient to liquify at least a portion of said $C_2$, $C_3$, $C_4$ and $C_5$ and higher molecular weight hydrocarbons and to liquify said methane;

(b) separating at least one first liquid phase portion, predominating in $C_2$, $C_3$, $C_4$ and $C_5$ and higher molecular weight hydrocarbons, from the thus cooled natural gas feed, in at least one first separation step;

(c) further separating said at least one first liquid phase portion, predominating in $C_2$, $C_3$, $C_4$ and $C_5$ and higher molecular weight hydrocarbons, in at least one second separation step, to recover a third liquid phase fraction predominating in $C_5$ and higher molecular weight hydrocarbons, as a product of the process, and at least one fourth liquid phase portion, predominating in $C_2$, $C_3$, and $C_4$ hydrocarbons;

(d) recycling one portion of said at least one fourth liquid phase portion comprising a stream of at least part of one of (1) said $C_2$, $C_3$ and $C_4$ hydrocarbons, (2) said $C_2$, and $C_3$ hydrocarbons and (3) said $C_3$ and $C_4$ hydrocarbons, in its uncompressed liquid phase, to the thus liquified methane; and (e) recovering the remaining portion of said at least one fourth liquid phase portion, which is not thus recycled to the thus liquified methane, as at least one product of the process.

2. A process in accordance with claim 1 wherein the at least one second separation step is a three-stage separation step.

3. A process in accordance with claim 2 wherein the first of the three-stage, at least one separation step separates $C_2$ hydrocarbons and lower boiling constituents as a vapor from $C_3$ and higher molecular weight hydrocarbons as a liquid, the second of said separation steps separates $C_3$ hydrocarbons as a vapor from $C_4$ and higher molecular weight hydrocarbons as a liquid and the third of said three-stage separation steps separates $C_4$ hydrocarbons as a vapor and $C_5$ and higher molecular weight hydrocarbons as a liquid.

4. A process in accordance with claim 1 wherein the at least one third liquid phase predominating in $C_2$, $C_3$ and $C_4$ hydrocarbons thus recycled to the natural gas feed predominates in $C_2$ and $C_3$ hydrocarbons.

5. A process in accordance with claim 1 wherein the thus recycled one portion of the at least one fourth liquid phase portion is recycled to the thus liquified methane after the last of the at least one first separation step.

6. A process in accordance with claim 1 wherein the one portion of the at least one fourth liquid phase portion thus recycled to the thus liquified methane is a stream of at least part of the $C_2$, $C_3$, and $C_4$ hydrocarbons.

7. A process in accordance with claim 1 wherein the one portion of the at least one fourth liquid phase portion thus recycled to the thus liquified methane is a stream of at least part of the $C_2$ and $C_3$ hydrocarbons.

8. A process in accordance with claim 6 or 7 wherein the at least one second separation step comprises four second separation steps.

9. A process in accordance with claim 8 wherein the first of the four second separation steps separates methane and lower boiling constituents as a vapor and $C_2$ and higher molecular weight hydrocarbons as a liquid, the second of said four second separation steps separates $C_2$ hydrocarbons as a vapor and $C_3$ and higher molecular weight hydrocarbons as a liquid, the third of said four second separation steps separates $C_3$ hydrocarbons as a vapor and $C_4$ and higher molecular weight hydrocarbons as a liquid and the fourth of said four second separation steps separates $C_4$ hydrocarbons as a vapor and $C_5$ and higher molecular weight hydrocarbons as a liquid and the stream of at least part of the $C_2$, $C_3$ and $C_4$ hydrocarbons and the stream of at least part of the $C_2$ and $C_3$ hydrocarbons, as the case may be, thus recycled to the thus liquified methane is condensed from the thus separated $C_2$, $C_3$ and $C_4$ vapors prior to thus recycling the same.

10. A process in accordance with claim 1 wherein the one portion of the at least one fourth liquid phase portion, thus recycled to the thus liquified methane, is a stream of at least part of the $C_3$ and $C_4$ hydrocarbons.

11. A process in accordance with claim 10 wherein the at least one second separation step comprises three second separation steps.

12. A process in accordance with claim 11 wherein the first of the three second separation steps separates $C_1$ and lower boiling constituents and $C_2$ hydrocarbons as a vapor and $C_3$ and higher molecular weight hydrocarbon as a liquid, the second of said three second separation steps separates $C_3$ hydrocarbons as a vapor and $C_4$ and higher molecular weight hydrocarbons as a liquid and the third of said three second separation steps separates said $C_4$ hydrocarbons as a vapor and $C_5$ and higher molecular weight hydrocarbons as a liquid and the stream of at least part of the $C_3$ and $C_4$ hydrocarbons, thus recycled to the thus liquified methane, is condensed from the $C_3$ and $C_4$ vapors prior to thus recycling the same.

13. A process in accordance with claim 1 wherein the at least one fourth liquid phase portion comprises separate $C_2$, $C_3$ and $C_4$ streams.

14. A process in accordance with claim 13 wherein the separate $C_2$, $C_3$ and $C_4$ hydrocarbon streams are recombined to form the streams of (1) $C_2$, $C_3$ and $C_4$ hydrocarbons, (2) $C_2$ and $C_3$ hydrocarbons and (3) $C_3$ and $C_4$ hydrocarbons, respectively, thus recycled to the thus liquified methane.

15. A process in accordance with claims 1, 5, 6, 7, 8, 9, 10, 11, 12, 13 or 14, wherein the at least one first separation step comprises a plurality of first separation steps following each of an equal number of cooling steps of the at least one first cooling stage, which are adapted to produce an equal number of liquid phase portions, of the at least one first liquid phase portion, of progressively lower molecular weights.

16. A process in accordance with claim 15 wherein the at least one second separation step includes a fractionation step, the highest molecular weight portion of the equal number of liquid phase portions of the at least one first liquid phase portion, predominating in $C_2$, $C_3$, $C_4$ and $C_5$ and higher molecular weight hydrocarbons, separated in the plurality of first separation steps is fed to a lowermost portion of said fractionation step and the progressively lower molecular weight portions of said equal number of liquid phase portions of said at least one first liquid phase portion, predominating in $C_2$, $C_3$, $C_4$ and $C_5$ and higher molecular weight hydrocarbons, separated in said plurality of said first separation steps are fed to said fractionation step at successively higher points.

17. A process in accordance with claim 16 wherein the one portion of the at least one fourth liquid phase portion thus recycled to the thus liquified methane is passed in indirect heat exchange with at least one fluid being separated in the fractionation step of the at least one second separation step.

18. A process in accordance with claim 17 wherein the at least one fourth liquid phase portion thus recycled to the thus liquified methane is passed in indirect heat exchange with at least one of (1) at least one of the feed streams to the fractionation step and (2) a side stream withdrawn from and returned to said fractionation step.

* * * * *